US009046062B2

(12) United States Patent
Tice

(10) Patent No.: US 9,046,062 B2
(45) Date of Patent: Jun. 2, 2015

(54) GREENHOUSE GAS CAPTURE SYSTEM AND METHOD

(75) Inventor: Jon K. Tice, Fort Worth, TX (US)

(73) Assignee: Dresser-Rand Company, Olean, NY (US)

( * ) Notice: Subject to any disclaimer, the term of this patent is extended or adjusted under 35 U.S.C. 154(b) by 449 days.

(21) Appl. No.: 12/877,835

(22) Filed: Sep. 8, 2010

(65) Prior Publication Data

US 2011/0072814 A1 Mar. 31, 2011

Related U.S. Application Data

(60) Provisional application No. 61/246,035, filed on Sep. 25, 2009.

(51) Int. Cl.

| | |
|---|---|
| ***F02B 25/06*** | (2006.01) |
| ***F02M 35/024*** | (2006.01) |
| *F02B 3/06* | (2006.01) |
| *F02B 37/00* | (2006.01) |
| *F02M 25/06* | (2006.01) |

(52) U.S. Cl.

CPC ..... *F02M 35/024* (2013.01); *F02B 3/06* (2013.01); *F02B 37/00* (2013.01); *F02M 25/06* (2013.01)

(58) Field of Classification Search

CPC ..... F02B 43/10; F02B 43/12; F02B 37/00; F02B 3/06; F02M 35/024; F02M 25/06

USPC ..... 29/890.14; 60/279, 605.2; 73/861; 123/283, 527, 537, 572, 573, 574, 575, 123/698, 531; 210/180; 422/5, 105; 431/5

See application file for complete search history.

(56) References Cited

U.S. PATENT DOCUMENTS

| | | | | |
|---|---|---|---|---|
| 868,358 | A | | 10/1907 | Noyes |
| 1,497,652 | A | * | 6/1924 | Browne ..... 285/13 |
| 4,058,147 | A | * | 11/1977 | Stary et al. ..... 141/45 |
| 4,066,055 | A | * | 1/1978 | Hager ..... 123/572 |
| 4,343,629 | A | * | 8/1982 | Dinsmore et al. ..... 95/93 |
| 4,570,603 | A | * | 2/1986 | Piedrafita ..... 123/510 |
| 4,958,613 | A | * | 9/1990 | Hiraoka et al. ..... 123/572 |
| 5,070,850 | A | * | 12/1991 | Davis et al. ..... 123/527 |
| 5,312,137 | A | * | 5/1994 | Nee ..... 285/14 |
| 5,330,720 | A | * | 7/1994 | Sorbo et al. ..... 422/98 |
| 5,337,859 | A | * | 8/1994 | Ingram et al. ..... 184/6.21 |
| 5,344,313 | A | * | 9/1994 | Johnsen, Jr. ..... 431/346 |

(Continued)

FOREIGN PATENT DOCUMENTS

WO 2011-037755 A2 3/2011

OTHER PUBLICATIONS

PCT/US2010/048240 International Search Report and Written Opinion dated Jun. 30, 2011 (9 pages).

*Primary Examiner* — Thai Ba Trieu
*Assistant Examiner* — Jason T Newton
(74) *Attorney, Agent, or Firm* — Edmonds & Nolte, PC

(57) ABSTRACT

A system and method for capturing emissions including a first vent configured to capture a first combustible fluid and an inlet configured to filter a noncombustible, wherein the combustible fluid and the noncombustible fluid are combined to form a diluted stream. A first valve may be in fluid communication with the first vent and the inlet, and the first valve may be configured to receive and control flow of the diluted stream. An engine may be in fluid communication with the first valve and configured to receive and combust the diluted stream.

18 Claims, 7 Drawing Sheets

(56) References Cited

U.S. PATENT DOCUMENTS

| | | | | |
|---|---|---|---|---|
| 5,611,204 | A * | 3/1997 | Radovanovic et al. | 60/605.2 |
| 5,732,766 | A * | 3/1998 | Hunter et al. | 165/111 |
| 5,979,227 | A * | 11/1999 | Lawson et al. | 73/46 |
| 6,378,511 | B1 * | 4/2002 | Wolters et al. | 123/575 |
| 6,393,821 | B1 | 5/2002 | Prabhu | |
| 6,578,559 | B2 * | 6/2003 | Kilmer | 123/527 |
| 6,796,324 | B2 * | 9/2004 | Dilger et al. | 137/312 |
| 7,155,961 | B2 * | 1/2007 | Fernandes et al. | 73/49.1 |
| 7,255,136 | B2 | 8/2007 | Templet et al. | |
| 7,520,743 | B1 * | 4/2009 | Roberts | 431/5 |
| 7,946,278 | B2 * | 5/2011 | Lim | 123/572 |
| 2003/0098065 | A1 * | 5/2003 | Dilger et al. | 137/312 |
| 2003/0192512 | A1 * | 10/2003 | Luley et al. | 123/519 |
| 2004/0197240 | A1 * | 10/2004 | Wheat et al. | 422/105 |
| 2005/0205022 | A1 | 9/2005 | Ito et al. | |
| 2006/0204909 | A1 | 9/2006 | Malm | |
| 2007/0051406 | A1 * | 3/2007 | Carns et al. | 137/312 |
| 2008/0127950 | A1 * | 6/2008 | Malm | 123/527 |
| 2008/0190400 | A1 * | 8/2008 | Bushnell et al. | 123/527 |

* cited by examiner

GREENHOUSE GAS CAPTURE SYSTEM AND METHOD

CROSS REFERENCE TO RELATED APPLICATIONS

This application claims priority to U.S. Patent Application Ser. No. 61/246,035, which was filed Sep. 25, 2009. The priority application is hereby incorporated by reference in its entirety into the present application.

BACKGROUND

This disclosure relates in general to greenhouse gases, and in particular to a system and method for capturing greenhouse gases.

Greenhouse gas emissions are typically vented, and/or leak, from a wide variety of industrial systems and equipment. These emissions are sometimes vented to the atmosphere and/or disposed of via wasteful means such as, for example, a flare. As a result, greenhouse gases are released into the environment and/or the energy in the greenhouse gases is lost. Therefore, what is needed is a system or configuration for capturing greenhouse gases that overcomes one or more of these problems.

SUMMARY

Embodiments of the present disclosure provide a system for capturing emissions. The system may include a first vent configured to capture a first combustible fluid and an inlet configured to filter a noncombustible fluid, wherein the combustible fluid and the noncombustible fluid are combined to form a diluted stream. A first valve may be in fluid communication with the first vent and the inlet, and the first valve may be configured to receive and control flow of the diluted stream. An engine may be in fluid communication with the first valve and configured to receive and combust the diluted stream.

Embodiments of the present disclosure also provide another system for capturing emissions. The system may include an engine coupled to and configured to drive a compressor. A first vent may be coupled to the compressor and configured to capture a first stream of greenhouse gas emissions from the compressor. A liquid separation mechanism may be coupled to the first vent and configured to remove condensable liquids from the first stream of greenhouse gas emissions. An inlet may be configured to filter a stream of air, wherein the first stream of greenhouse gas emissions and the air are combined to form a first diluted stream. A first valve may be in fluid communication with the first vent and the inlet, and the first valve may be configured to receive and control flow of the first diluted stream. A second vent may be coupled to the engine, and the second vent may be configured to capture a second stream of greenhouse gas emissions from the engine, wherein first diluted stream and the second stream of greenhouse gas emissions are combined to form a second diluted stream. An engine inlet may be configured to receive the second diluted stream and to provide the second diluted stream to the engine, wherein the engine combusts the second diluted stream.

Embodiments of the present disclosure further provide a method for capturing emissions. The method may include capturing a combustible fluid from a compressor with a first vent. The combustible fluid may be combined with a noncombustible fluid to form a diluted stream. A control valve may regulate a flow of the diluted stream to an engine, and the engine may combust the diluted stream.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
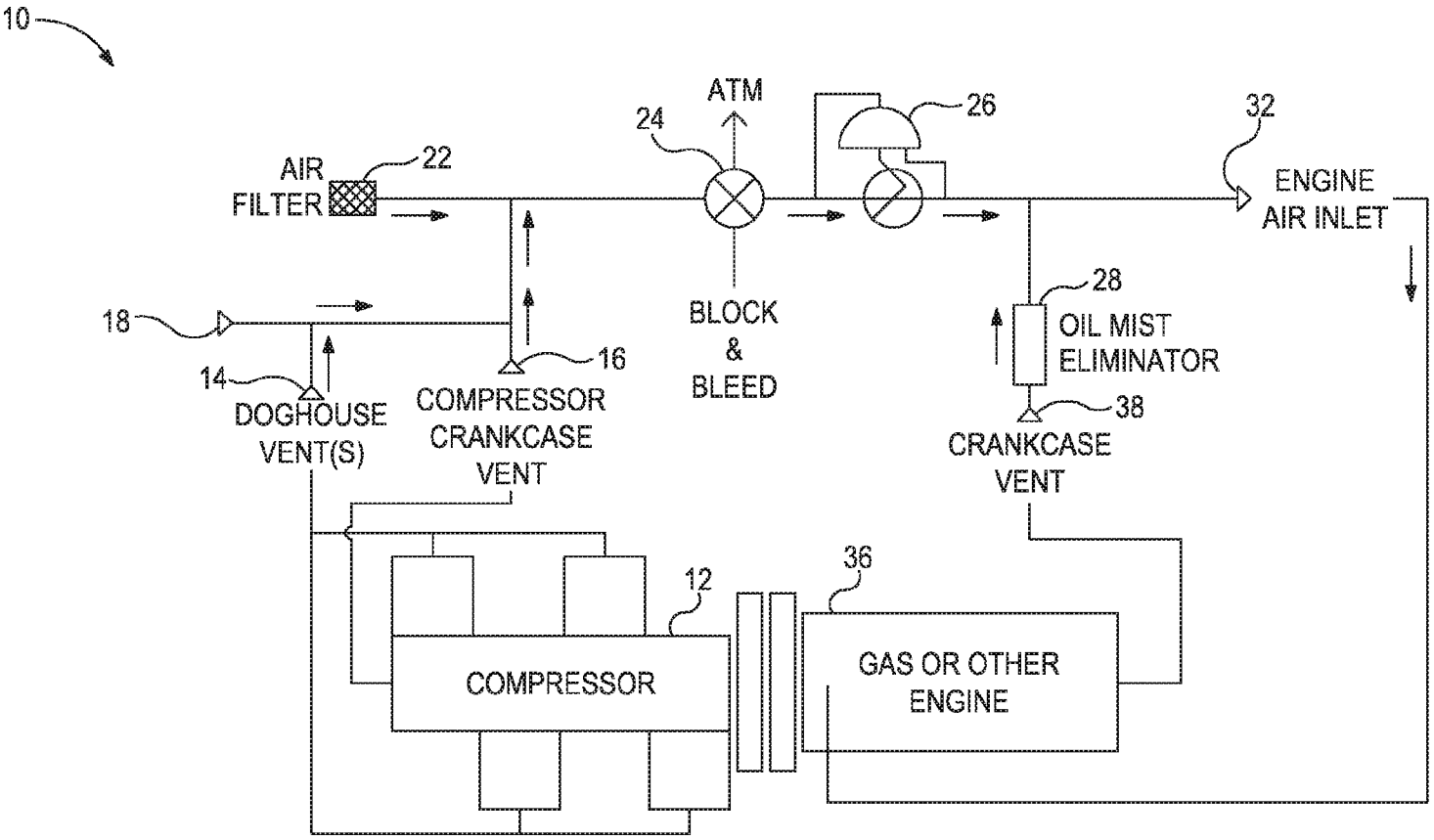
FIG. 1 is a diagrammatic view of a greenhouse gas capture system according to an exemplary embodiment.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope.

In an exemplary embodiment, as illustrated in FIG. 1, a greenhouse gas ("GHG") capture system is generally referred to by the reference numeral 10 and includes a compressor 12 with one or more doghouse outlets or vents 14 and one or more compressor crankcase outlets or vents 16 coupled thereto. The doghouse vents 14 and the crankcase vents 16 are in fluid communication with a valve such as a block and bleed valve 24. One or more tank vents 18 are also in fluid communication with the block and bleed valve 24. An inlet such as an air filter 22 is also in fluid communication with the block and bleed valve 24. A valve such as a control valve 26 is in fluid communication with the block and bleed valve 24. The control valve 26 and an oil mist eliminator 28 are in fluid communication with an engine air inlet 32, which includes one or more fixed orifices, one or more variable orifices, and/or any combination thereof. The engine air inlet 32 is in fluid communication with an engine 36, which is operably coupled to the compressor 12. One or more engine crankcase vents 38 are coupled to the engine 36 and are in fluid communication with the oil mist eliminator 28. In an exemplary embodiment, the compressor 12 is a four-throw compressor. In several exemplary embodiments, instead of a four-throw compressor, the compressor 12 is another type of compressor. In an exemplary embodiment, the engine 36 is a turbo-compression diesel engine. In several exemplary embodiments, instead of a turbo-compression diesel engine, the engine 36 is another type of engine such as, for example, another type of gasoline engine.

Each of the doghouse vents 14, the compressor crankcase vents 16, the tank vents 18, and the engine crankcase vents 38 includes one or more fixed orifices, one or more variable orifices, and/or any combination thereof, and are configured to capture and direct combustible fluids such as, for example, fugitive or vented emissions including combustible fluids such as, for example, GHG emissions, which are traditionally vented to the atmosphere. More particularly, the doghouse vents 14 and the compressor crankcase vents 16 are configured to capture and direct fugitive or vented GHG emissions from the compressor 12. The tank vents 18 are configured to capture and direct fugitive or vented GHG emissions from one or more tanks in proximity to the GHG capture system 10. The engine crankcase vents 38 are designed to capture and direct fugitive or vented GHG emissions from the engine 36.

In several exemplary embodiments, the doghouse vents 14, the compressor crankcase vents 16, the tank vents 18, and the engine crankcase vents 38 are configured to regulate flows within the GHG capture system 10. The doghouse vents 14, the compressor crankcase vents 16, the tank vents 18, and the engine crankcase vents 38 may include one or more fixed, variable, manual, or automatic flow control devices, and/or any combination thereof, with one or more of the flow control devices including, for example, a back pressure control regulator and/or an electronically controlled valve or regulator, which valves or regulators limit the flow of the emissions though the respective fixed and/or variable orifices of the doghouse vents 14, the compressor crankcase vents 16, the tank vents 18, and the engine crankcase vents 38 to facilitate in controlling pressures within the GHG capture system 10. In an exemplary embodiment, the doghouse vents 14, the compressor crankcase vents 16, the tank vents 18, and the engine crankcase vents 38 also include or otherwise incorporate one or more types of vapor recovery systems for capturing fugitive or vented vapors.

The air filter 22 is configured to filter ambient air (and/or another noncombustible fluid), which is adapted to be drawn into the GHG capture system 10 through the air filter 22 and mix with the fugitive or vented GHG emissions captured and directed by the doghouse vents 14, the compressor crankcase vents 16, the tank vents 18, and the engine crankcase vents 38 to thereby dilute the GHG emissions, under conditions to be described below. The block and bleed valve 24, when activated, is configured to isolate the portion of the GHG capture system 10 upstream of the block and bleed valve 24 from the portion of the GHG capture system 10 downstream of the block and bleed valve 24, thereby protecting the downstream portion including the engine 36. If the block and bleed valve 24 is activated, the captured GHG emissions upstream of the valve 24 are then diverted out of the GHG capture system 10 via the block and bleed valve 24 and/or the air filter 22 to the atmosphere and/or a disposal mechanism such as, for example, a flare.

The control valve 26 is configured to entrain and homogenize the captured GHG emissions and filtered air into a diluted stream. In an exemplary embodiment, the control valve 26 is a diaphragm-type valve with a spring control. In an exemplary embodiment, the control valve 26 is a pressure balanced operating valve. In an exemplary embodiment, the control valve 26 is manually controlled, and is configured to be adjusted by an operator to avoid over-capture of emissions from the doghouse vents 14, the compressor crankcase vents 16, the tank vents 18, and the engine crankcase vents 38, which over-capture may lead to over-saturation of GHG in the diluted stream entering the engine air inlet 32 and thus possible damage to the engine 36. In an exemplary embodiment, the control valve 26 is configured to be adjusted by an electronic controller to avoid over-capture of the emissions from the doghouse vents 14, the compressor crankcase vents 16, the tank vents 18, and the engine crankcase vents 38, which over-capture could damage the engine 36. In an exemplary embodiment, the electronic controller that adjusts the control valve 26 is configured to respond to changes in the composition of the captured emissions by adjusting the control valve 26 to optimize GHG capture in order to keep the diluted stream below the lean flammability limit, thereby protecting existing engine control and emission systems.

In operation, in an exemplary embodiment, the engine 36 operates to drive the compressor 12, during which the engine 36 ingests air via the engine air inlet 32 and/or one or more inlets other than the engine air inlet 32. As a result of the operation of the engine 36, GHG emissions are generated, and at least a portion of these emissions are captured and directed by the engine crankcase vents 38. As a result of the operation of the compressor 12, GHG emissions are generated, and at least a portion of these emissions are captured and directed by the doghouse vents 14 and the compressor crankcase vents 16. GHG emissions are also captured and directed by the tank vents 18. During the normal operation of the engine 36 and the compressor 12, the block and bleed valve 24 and the control valve 26 are open or at least partially open, allowing fluid to flow therethrough, and the inlet pressure of the air filter 22 is at atmospheric pressure, the pressure between the engine 36 and the engine crankcase vents 38 is at or near atmospheric pressure, the pressure downstream of the doghouse vents 14, the compressor crankcase vents 16 and the tank vents 18 is less than atmospheric pressure, the pressure downstream of the block and bleed valve 24 (and thus upstream of the control valve 26) is less than atmospheric pressure, and the pressure at the engine air inlet 32 is less than the pressure upstream of the control valve 26.

As a result of the foregoing pressure differentials, air (and/or another noncombustible fluid) is drawn into the GHG capture system 10 via the air filter 22 and flows toward the block and bleed valve 24. Further, GHG emissions captured and directed by the tank vents 18, the doghouse vents 14 and the compressor crankcase vents 16 also flow toward the block and bleed valve 24; as a result, these GHG emissions mix with, and thus are diluted by, the air flowing through the air filter 22. The diluted stream flows through the block and bleed valve 24 and the control valve 26. Since the inlet pressure of the control valve 26 is above the inlet pressure of the engine air inlet 32, the diluted stream is drawn into the engine 36 via the engine air inlet 32. Since the pressure between the engine 36 and the engine crankcase vents 38 is at or near atmospheric pressure, GHG emissions captured and directed by the engine crankcase vents 38 flow toward the engine air inlet 32, thereby mixing with, and thus being diluted by, the diluted stream before the diluted stream is drawn into the engine 36 via the engine air inlet 32. The diluted stream conveys the captured GHG emissions into the air-fuel system of the engine 36 through the engine air inlet 32 in a manner that avoids interfering with the engine controls or any sensitive air-fuel ratios or emission control systems.

The control valve 26 facilitates the mixing of air with the emissions captured by the doghouse vents 14, the compressor crankcase vents 16, the tank vents 18, and/or the engine crankcase vents 38. The diluted stream exiting the control valve 26 is below the lean flammability limit, so that the diluted stream will not easily combust. In an exemplary embodiment, the composition of the diluted stream is at least twenty percent lean of the stoichiometric ratio of combustion. By managing flow through the GHG capture system 10, the control valve 26 regulates the introduction of the diluted stream to the engine 36 for combustion.

The engine 36 ingests and combusts the diluted stream in order to convert the captured GHG emissions to carbon dioxide. When the engine 36 is in operation, combustion in the engine 36 converts methane and longer chain carbon gases in the diluted stream to carbon dioxide. In this way, the GHG capture system 10 reduces the amount of methane and longer chain carbon gases released to the atmosphere, while increasing the amount of carbon dioxide released to the atmosphere. Longer chain carbon gases generally have greater greenhouse effects than carbon dioxide. Methane, for example, has over twenty times greater greenhouse causing effects than carbon dioxide when released into the atmosphere. The engine 36 combusts the otherwise wasted hydrocarbon gases in the captured emissions to also recover the energy value of the emissions. The diluted GHG emissions are combusted along with a fuel in the engine 36, thereby adding the energy value of the vented emissions to the engine 36. This energy supplements the required energy output from the engine 36, reducing the fuel requirement in proportion to the energy recovered from the captured emissions. This results in a fuel savings during operation of the engine 36.

As noted above, the block and bleed valve 24, when activated, isolates the portion of the GHG capture system 10 upstream of the block and bleed valve 24 from the portion of the GHG capture system 10 downstream of the block and bleed valve 24, thereby protecting the downstream portion including the engine 36. The captured GHG emissions upstream of the block and bleed valve 24 are then diverted out of the GHG capture system 10 via the valve 24 and/or the air filter 22 to the atmosphere and/or a disposal mechanism such as, for example, a flare.

In several exemplary embodiments, the operation of the GHG capture system 10 presents an approach to GHG recovery through active management of the emissions flow from the doghouse vents 14, the crankcase vents 16, the tank vents 18, and the crankcase vents 38, other GHG recovery points, and/or any combination thereof, as needed. Each potential source of captured emissions may be associated with manual or electronic controls to adapt to varying compositions and heating values of the emissions. The GHG capture system 10 does not create back pressure on the doghouse vents 14, the crankcase vents 16, the tank vents 18, or the crankcase vents 38, eliminating, or at least reducing, the risk of explosion. In several exemplary embodiments, the GHG capture system 10 does not rely on pressure relief valves to protect machinery and personnel; however, additional instrumentation and safety devices may be applied to the GHG capture system 10 to increase the margin of safety or reliability.

In several exemplary embodiments, the GHG capture system 10 includes other dilution mechanisms that contribute to the mixing of air (and/or another noncombustible fluid) with the captured emissions. These dilution mechanisms may include a simple tube of sufficient length or a specialized chamber with mixing vanes to ensure homogeneous mixing.

In exemplary embodiments, fugitive GHG emissions traditionally released to the atmosphere are captured by shrouds that enclose valves, flanges and/or mechanical connections in proximity to, and/or that are a part of, the GHG capture system 10, as will be described in further detail below in connection with FIGS. 5, 6 and 7.

Figure 2:
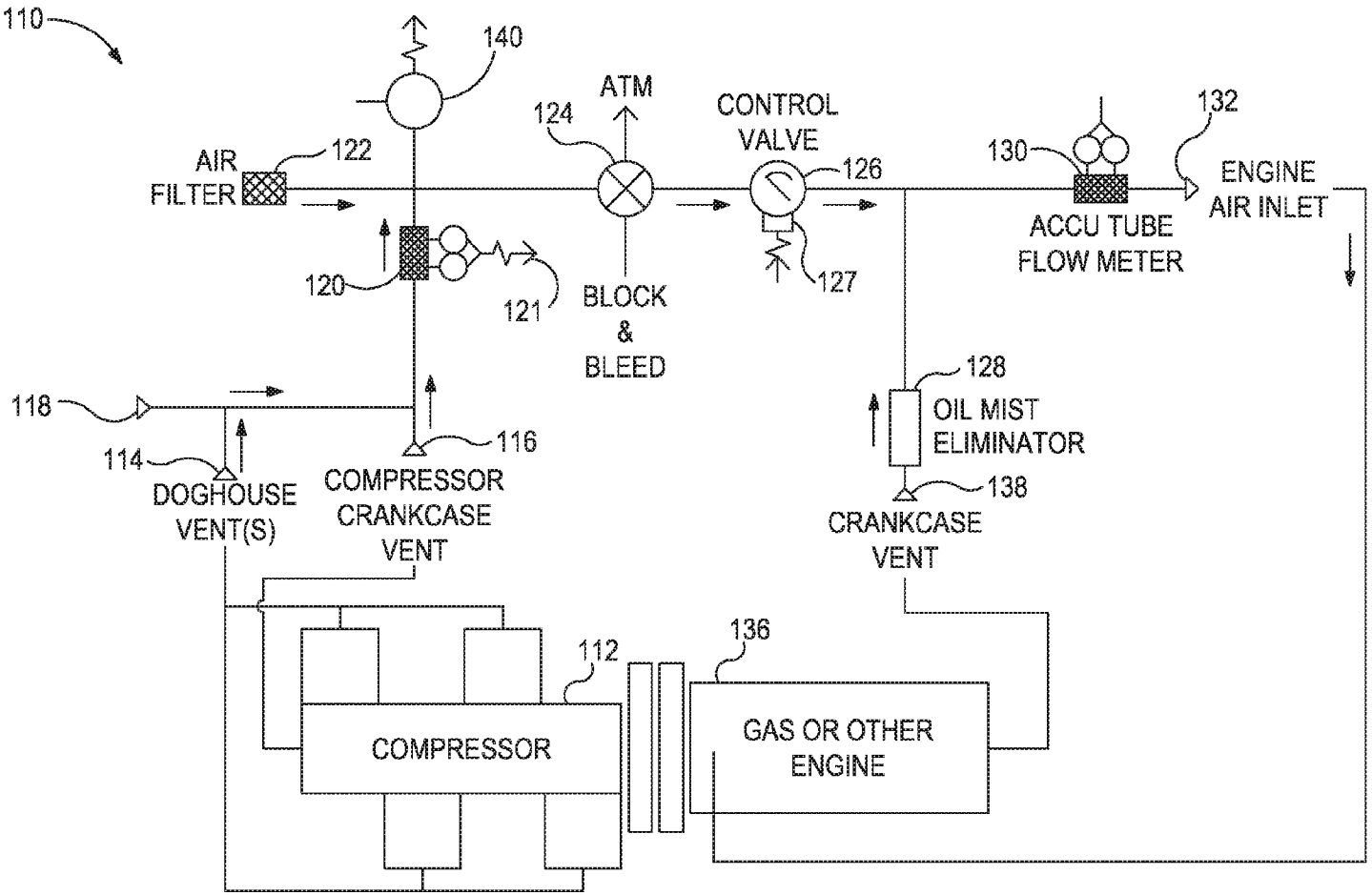
FIG. 2 is a diagrammatic view of a greenhouse gas capture system according to another exemplary embodiment.

In an exemplary embodiment, as illustrated in FIG. 2, a GHG capture system is generally referred to by the reference numeral 110 and includes a compressor 112 with one or more doghouse vents 114 and one or more compressor crankcase vents 116 coupled thereto. The doghouse vents 114, the crankcase vents 116, and one or more tank vents 118 are in fluid communication with a flow meter 120, which, in turn, is in fluid communication with a valve such as a block and bleed valve 124. The flow meter 120 is electrically coupled to an electronic controller 121. An air filter 122 is also in fluid communication with the block and bleed valve 124. A valve such as a control valve 126 is in fluid communication with the block and bleed valve 124. The control valve 126 is electrically coupled to a controller 127. The control valve 126 and an oil mist eliminator 128 are in fluid communication with a flow meter 130, which, in turn, is in fluid communication with an engine air inlet 132, which includes one or more fixed orifices, one or more variable orifices, and/or any combination thereof. The engine air inlet 132 is in fluid communication with an engine 136, which is operably coupled to the compressor 112. One or more engine crankcase vents 138 are coupled to the engine 136 and are in fluid communication with the oil mist eliminator 128. In an exemplary embodiment, the compressor 112 is a four-throw compressor. In several exemplary embodiments, instead of a four-throw compressor, the compressor 112 is another type of compressor. In an exemplary embodiment, the engine 136 is a turbo-compression diesel engine. In several exemplary embodiments, instead of a turbo-compression diesel engine, the engine 136 is another type of engine such as, for example, another type of gasoline engine.

Each of the doghouse vents 114, the compressor crankcase vents 116, the tank vents 118, and the engine crankcase vents 138 includes one or more fixed orifices, one or more variable orifices, and/or any combination thereof, and are configured to capture and direct combustible fluids such as, for example, fugitive or vented emissions including combustible fluids such as, for example, GHG emissions, which are traditionally vented to the atmosphere. More particularly, the doghouse vents 114 and the compressor crankcase vents 116 are configured to capture and direct fugitive or vented GHG emissions from the compressor 112. The tank vents 118 are configured to capture and direct fugitive or vented GHG emissions from one or more tanks in proximity to the GHG capture system 110. The engine crankcase vents 138 are designed to capture and direct fugitive or vented GHG emissions from the engine 136.

In several exemplary embodiments, the doghouse vents 114, the compressor crankcase vents 116, the tank vents 118, and the engine crankcase vents 138 are configured to regulate flows within the GHG capture system 110. The doghouse vents 114, the compressor crankcase vents 116, the tank vents 118, and the engine crankcase vents 138 may include one or more fixed, variable, manual, or automatic flow control devices, and/or any combination thereof, with one or more of the flow control devices including, for example, a back pressure control regulator and/or an electronically controlled valve or regulator, which valves or regulators limit the flow of the emissions though the respective fixed and/or variable orifices of the doghouse vents 114, the compressor crankcase vents 116, the tank vents 118, and the engine crankcase vents 138 to facilitate in controlling pressures within the GHG capture system 110. In an exemplary embodiment, the doghouse vents 114, the compressor crankcase vents 116, the tank vents 118, and the engine crankcase vents 138 also include or otherwise incorporate one or more types of vapor recovery systems for capturing fugitive or vented vapors.

The air filter 122 is configured to filter ambient air (and/or another noncombustible fluid), which is adapted to be drawn into the GHG capture system 110 through the air filter 122 and mix with the fugitive or vented GHG emissions captured and directed by the doghouse vents 114, the compressor crankcase vents 116, the tank vents 118, and the engine crankcase vents 138 to thereby dilute the GHG emissions, under conditions to be described below.

The block and bleed valve 124, when activated, is configured to isolate the portion of the GHG capture system 110 upstream of the block and bleed valve 124 from the portion of the GHG capture system 110 downstream of the block and bleed valve 124, thereby protecting the downstream portion including the engine 136. If the block and bleed valve 124 is activated, the captured GHG emissions upstream of the valve 124 are then diverted out of the GHG capture system 110 via the valve 124 and/or the air filter 122 to the atmosphere and/or a disposal mechanism such as, for example, a flare. A controller may be electrically coupled to the block and bleed valve 124 and may be configured to automatically control the block and bleed valve 124.

The control valve 126 is configured to entrain and homogenize the captured GHG emissions and filtered air into a diluted stream. In an exemplary embodiment, the control valve 126 is controlled with the controller 127; the control valve 126 is adjusted by the controller 127 to avoid over-capture of emissions from the doghouse vents 114, the compressor crankcase vents 116, the tank vents 118, and the engine crankcase vents 138, which over-capture may lead to over-saturation of GHG in the diluted stream entering the engine air inlet 132 and thus possible damage to the engine 136. In an exemplary embodiment, the controller 127 is configured to respond to changes in the composition of the captured emissions by adjusting the control valve 126 to optimize GHG capture in order to keep the diluted stream below the lean flammability limit, thereby protecting existing engine control and emission systems. The control valve 126 may be electrically controlled for immediate and accurate control of pressures within the GHG capture system 110.

The flow meter 120 is configured to measure the flow rate of the GHG emissions from the doghouse vents 114, the compressor crankcase vents 116 and the tank vents 118. The flow meter 130 is configured to measure the flow rate of the diluted stream into the engine air inlet 132. The controller 121 is configured to automatically control one or more of the flow meter 120, the flow meter 130, one or more of the orifices of one or more of the doghouse vents 114, the compressor crankcase vents 116, the tank vents 118, and the engine crankcase vents 138, the block and bleed valve 124, one or more of the remaining components of the GHG capture system 110, and/or any combination thereof. Similarly, a controller may be electrically coupled to the flow meter 130, and may be configured to automatically control one or more of the flow meter 120, the flow meter 130, one or more of the orifices of one or more of the doghouse vents 114, the compressor crankcase vents 116, the tank vents 118, and the engine crankcase vents 138, the block and bleed valve 124, one or more of the remaining components of the GHG capture system 110, and/or any combination thereof.

In operation, in an exemplary embodiment, the engine 136 operates to drive the compressor 112, during which the engine 136 ingests air via the engine air inlet 132 and/or one or more inlets other than the engine air inlet 132. As a result of the operation of the engine 136, GHG emissions are generated, and at least a portion of these emissions are captured and directed by the engine crankcase vents 138. As a result of the operation of the compressor 112, GHG emissions are generated, and at least a portion of these emissions are captured and directed by the doghouse vents 114 and the compressor crankcase vents 116. GHG emissions are also captured and directed by the tank vents 118. During the normal operation of the engine 136 and the compressor 112, the block and bleed valve 124 and the control valve 126 are open or at least partially open, allowing fluid to flow therethrough, and the inlet pressure of the air filter 122 is at atmospheric pressure, the pressure between the engine 136 and the engine crankcase vents 138 is at or near atmospheric pressure, the pressure downstream of the doghouse vents 114, the compressor crankcase vents 116 and the tank vents 118 is less than atmospheric pressure, the pressure downstream of the block and bleed valve 124 (and thus upstream of the control valve 126) is less than atmospheric pressure, and the pressure at the engine air inlet 132 is less than the pressure upstream of the control valve 126.

As a result of the foregoing pressure differentials, air (and/or another noncombustible fluid) is drawn into the GHG capture system 110 via the air filter 122 and flows toward the block and bleed valve 124. Further, GHG emissions captured and directed by the tank vents 118, the doghouse vents 114 and the compressor crankcase vents 116 also flow toward the block and bleed valve 124; as a result, these GHG emissions mix with, and thus are diluted by, the air flowing through the air filter 122. The diluted stream flows through the block and bleed valve 124 and the control valve 126. Since the inlet pressure of the control valve 126 is above the inlet pressure of the engine air inlet 132, the diluted stream is drawn into the engine 136 via the engine air inlet 132. Since the pressure between the engine 136 and the engine crankcase vents 138 is at or near atmospheric pressure, GHG emissions captured and directed by the engine crankcase vents 138 flow toward the engine air inlet 132, thereby mixing with, and thus being diluted by, the diluted stream before the diluted stream is drawn into the engine 136 via the engine air inlet 132. The diluted stream conveys the captured GHG emissions into the air-fuel system of the engine 136 through the engine air inlet 132 in a manner that avoids interfering with the engine controls or any sensitive air-fuel ratios or emission control systems.

The control valve 126 facilitates the mixing of air with the emissions captured by the doghouse vents 114, the compressor crankcase vents 116, and the tank vents 118, and/or the engine crankcase vents 138. The diluted stream exiting the control valve 126 is below the lean flammability limit, so that the diluted stream will not easily combust. In an exemplary embodiment, the composition of the diluted stream is at least twenty percent lean of the stoichiometric ratio of combustion. By managing flow through the GHG capture system 110, the control valve 126 regulates the introduction of the diluted stream to the engine 136 for combustion.

The engine 136 ingests and combusts the diluted stream in order to convert the captured GHG emissions to carbon dioxide. When the engine 136 is in operation, combustion in the engine 136 converts methane and longer chain carbon gases in the diluted stream to carbon dioxide. In this way, the GHG capture system 110 reduces the amount of methane and longer chain carbon gases released to the atmosphere, while increasing the amount of carbon dioxide released to the atmosphere. Longer chain carbon gases generally have greater greenhouse effects than carbon dioxide. Methane, for example, has over twenty times greater greenhouse causing effects as carbon dioxide when released into the atmosphere. The engine 136 combusts the otherwise wasted hydrocarbon gases in the captured emissions to also recover the energy value of the emissions. The diluted GHG emissions are combusted along with a fuel in the engine 136, thereby adding the energy value of the vented emissions to the engine 136. This energy supplements the required energy output from the engine 136, reducing the fuel requirement in proportion to the energy recovered from the captured emissions. This results in a fuel savings during operation of the engine 136.

As noted above, the block and bleed valve 124, when activated, isolates the portion of the GHG capture system 110 upstream of the block and bleed valve 124 from the portion of the GHG capture system 110 downstream of the block and bleed valve 124, thereby protecting the downstream portion including the engine 136. The captured GHG emissions upstream of the block and bleed valve 124 are then diverted out of the GHG capture system 110 via the valve 124 and/or the air filter 122 to the atmosphere and/or a disposal mechanism such as, for example, a flare.

During operation, the flow meters 120 and 130 measure flow rates within, and permit the automation of, the GHG capture system 110 with one or more of the controllers 121 and 127 and other controllers included in the GHG capture system 110, such as a controller 140. For example, using data gleaned from the flow meter 120 and the flow meter 130, the position of the control valve 126 is automatically adjusted with the controller 127 to maintain a correct amount of flow in the correct direction within the GHG capture system 110. As a result of the operation of one or more of the flow meters 120 and 130, the controllers 121, 127 and 140, and other controllers included in the GHG capture system 110, the control function of the system 110 may be decoupled from the pressures within the system 110, the control function of the system 110 does not have to be limited to one or more proportional constants, and/or the control function of the system 110 may be nonlinear.

In several exemplary embodiments, the operation of the GHG capture system 110 presents an approach to GHG recovery through active management of the emissions flow from the doghouse vents 114, the crankcase vents 116, the tank vents 118, and the crankcase vents 138, other GHG recovery points, and/or any combination thereof, as needed. Each potential source of captured emissions may be associated with manual or electronic controls to adapt to varying compositions and heating values of the emissions. The GHG capture system 110 does not create back pressure on the doghouse vents 114, the crankcase vents 116, the tank vents 118, or the crankcase vents 138, eliminating, or at least reducing, the risk of explosion. In several exemplary embodiments, the GHG capture system 110 does not rely on pressure relief valves to protect machinery and personnel; however, additional instrumentation and safety devices may be applied to the GHG capture system 110 to increase the margin of safety or reliability.

In several exemplary embodiments, the GHG capture system 110 includes other dilution mechanisms that contribute to the mixing of air (and/or another noncombustible fluid) with the captured emissions. These dilution mechanisms may include a simple tube of sufficient length or a specialized chamber with mixing vanes to ensure homogeneous mixing.

In exemplary embodiments, fugitive GHG emissions traditionally released to the atmosphere are captured by shrouds that enclose valves, flanges and/or mechanical connections in proximity to, and/or that are a part of, the GHG capture system 110, as will be described in further detail below in connection with FIGS. 5, 6 and 7.

Figure 3:
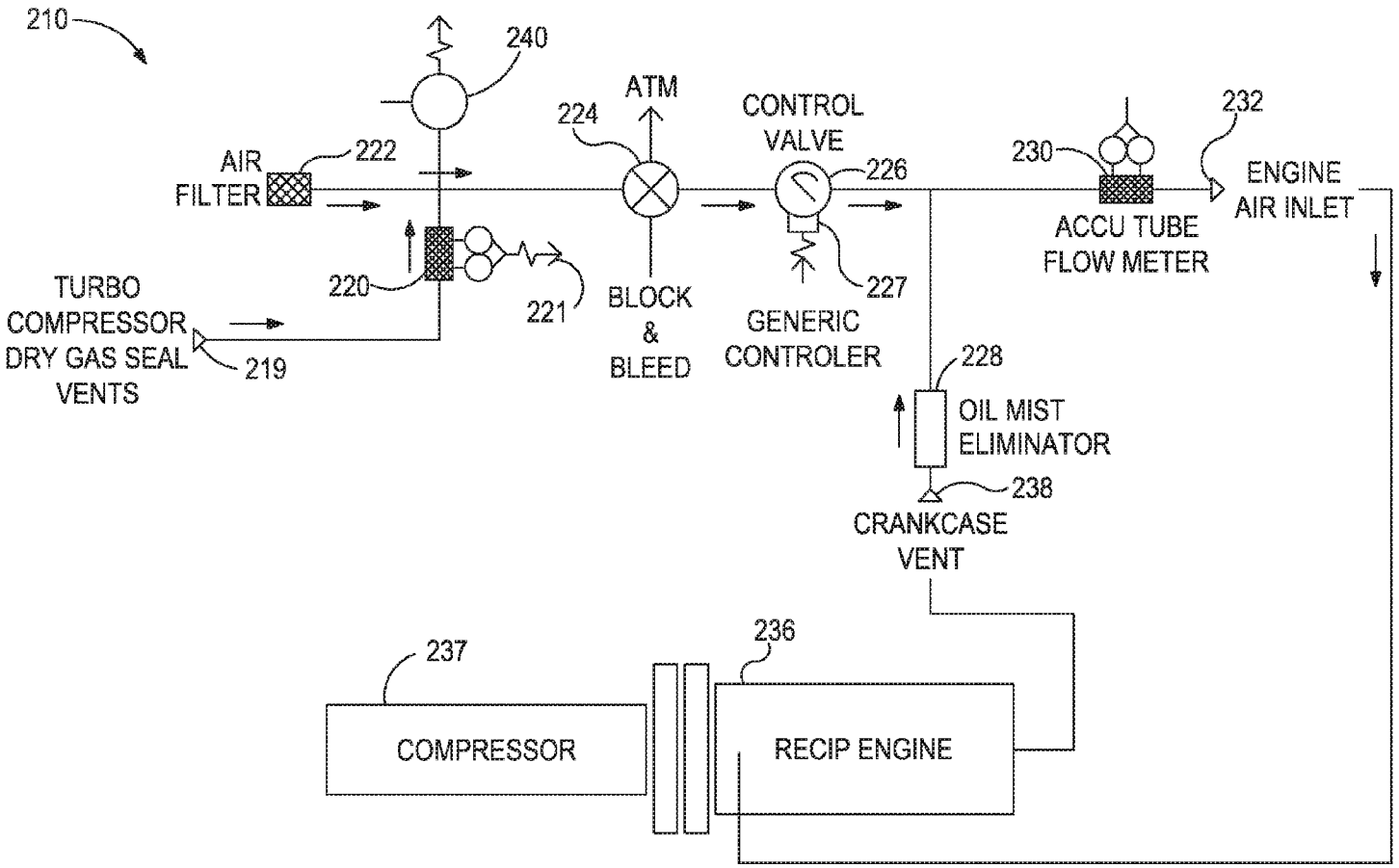
FIG. 3 is a diagrammatic view of a greenhouse gas capture system according to yet another exemplary embodiment.

In an exemplary embodiment, as illustrated in FIG. 3, a GHG capture system is generally referred to by the reference numeral 210 and includes a compressor with one or more dry gas seal vents 219 coupled thereto. The dry gas seal vents 219 are in fluid communication with a flow meter 220, which, in turn, is in fluid communication with a valve such as a block and bleed valve 224. The flow meter 220 is electrically coupled to an electronic controller 221. An air filter 222 is also in fluid communication with the block and bleed valve 224. A valve such as a control valve 226 is in fluid communication with the block and bleed valve 224. The control valve 226 is electrically coupled to a controller 227. The control valve 226 and an oil mist eliminator 228 are in fluid communication with a flow meter 230, which, in turn, is in fluid communication with an engine air inlet 232, which includes one or more fixed orifices, one or more variable orifices, and/or any combination thereof. The engine air inlet 232 is in fluid communication with an engine 236, which is operably coupled to a generator 237. One or more engine crankcase vents 238 are coupled to the engine 236 and are in fluid communication with the oil mist eliminator 228. In an exemplary embodiment, the engine 136 is a reciprocating engine.

Each of the dry gas seal vents 219 and the engine crankcase vents 238 includes one or more fixed orifices, one or more variable orifices, and/or any combination thereof, and are configured to capture and direct combustible fluids such as, for example, fugitive or vented emissions including combustible fluids such as, for example, GHG emissions, which are traditionally vented to the atmosphere. More particularly, the dry gas seal vents 219 are configured to capture and direct fugitive or vented GHG emissions from the compressor coupled to the dry gas seal vents 219, and the engine crankcase vents 238 are designed to capture and direct fugitive or vented GHG emissions from the engine 236.

In several exemplary embodiments, the dry gas seal vents 219 and the engine crankcase vents 238 are configured to regulate flows within the GHG capture system 210. The dry gas seal vents 219 and the engine crankcase vents 238 may include one or more fixed, variable, manual, or automatic flow control devices, and/or any combination thereof, with one or more of the flow control devices including, for example, a back pressure control regulator and/or an electronically controlled valve or regulator, which valves or regulators limit the flow of the emissions though the respective fixed and/or variable orifices of the dry gas seal vents 219 and the engine crankcase vents 238 to facilitate in controlling pressures within the GHG capture system 210. In an exemplary embodiment, the dry gas seal vents 219 and the engine crankcase vents 238 also include or otherwise incorporate one or more types of vapor recovery systems for capturing fugitive or vented vapors.

The air filter 222 is configured to filter ambient air (and/or another noncombustible fluid), which is adapted to be drawn into the GHG capture system 210 through the air filter 222 and mix with the fugitive or vented GHG emissions captured and directed by the dry gas seal vents 219 and the engine crankcase vents 238 to thereby dilute the GHG emissions, under conditions to be described below.

The block and bleed valve 224, when activated, is configured to isolate the portion of the GHG capture system 210 upstream of the block and bleed valve 224 from the portion of the GHG capture system 210 downstream of the block and bleed valve 224, thereby protecting the downstream portion including the engine 236. If the block and bleed valve 224 is activated, the captured GHG emissions upstream of the valve 224 are then diverted out of the GHG capture system 210 via the valve 224 and/or the air filter 222 to the atmosphere and/or a disposal mechanism such as, for example, a flare. A controller may be electrically coupled to the block and bleed valve 224 and may be configured to automatically control the block and bleed valve 224.

The control valve 226 is configured to entrain and homogenize the captured GHG emissions and filtered air into a diluted stream. In an exemplary embodiment, the control valve 226 is controlled with the controller 227; the control valve 226 is adjusted by the controller 227 to avoid over-capture of emissions from the dry gas seal vents 219 and the engine crankcase vents 238, which over-capture may lead to over-saturation of GHG in the diluted stream entering the engine air inlet 132 and thus possible damage to the engine 236. In an exemplary embodiment, the controller 227 is configured to respond to changes in the composition of the captured emissions by adjusting the control valve 226 to optimize GHG capture in order to keep the diluted stream below the lean flammability limit, thereby protecting existing engine control and emission systems. The control valve 226 may be electrically controlled for immediate and accurate control of pressures within the GHG capture system 210.

The flow meter 220 is configured to measure the flow rate of the GHG emissions from the dry gas seal vents 219. The flow meter 230 is configured to measure the flow rate of the diluted stream into the engine air inlet 232. The controller 221 is configured to automatically control one or more of the flow meter 220, the flow meter 230, one or more of the orifices of one or more of the dry gas seal vents 219 and the engine crankcase vents 238, the block and bleed valve 224, one or more of the remaining components of the GHG capture system 210, and/or any combination thereof. Similarly, a controller may be electrically coupled to the flow meter 230, and may be configured to automatically control one or more of the flow meter 220, the flow meter 230, one or more of the orifices of one or more of the dry gas seal vents 219 and the engine crankcase vents 238, the block and bleed valve 224, one or more of the remaining components of the GHG capture system 210, and/or any combination thereof.

In operation, in an exemplary embodiment, the engine 236 operates to drive the generator 237, during which the engine 236 ingests air via the engine air inlet 232 and/or one or more inlets other than the engine air inlet 232. As a result of the operation of the engine 236, GHG emissions are generated, and at least a portion of these emissions are captured and directed by the engine crankcase vents 238. As a result of the operation of the compressor to which the dry gas seal vents 219 are coupled, GHG emissions are generated, and at least a portion of these emissions are captured and directed by the dry gas seal vents 219. During the normal operation of the engine 236 and the compressor to which the dry gas seal vents 219 are coupled, the block and bleed valve 224 and the control valve 226 are open or at least partially open, allowing fluid to flow therethrough, and the inlet pressure of the air filter 222 is at atmospheric pressure, the pressure between the engine 236 and the engine crankcase vents 238 is at or near atmospheric pressure, the pressure downstream of the dry gas seal vents 219 is less than atmospheric pressure, the pressure downstream of the block and bleed valve 224 (and thus upstream of the control valve 226) is less than atmospheric pressure, and the pressure at the engine air inlet 232 is less than the pressure upstream of the control valve 226.

As a result of the foregoing pressure differentials, air (and/or another noncombustible fluid) is drawn into the GHG capture system 210 via the air filter 222 and flows toward the block and bleed valve 224. Further, GHG emissions captured and directed by the dry gas seal vents 219 also flow toward the block and bleed valve 224; as a result, these GHG emissions mix with, and thus are diluted by, the air flowing through the air filter 222. The diluted stream flows through the block and bleed valve 224 and the control valve 226. Since the inlet pressure of the control valve 226 is above the inlet pressure of the engine air inlet 232, the diluted stream is drawn into the engine 236 via the engine air inlet 232. Since the pressure between the engine 236 and the engine crankcase vents 238 is at or near atmospheric pressure, GHG emissions captured and directed by the engine crankcase vents 238 flow toward the engine air inlet 232, thereby mixing with, and thus being diluted by, the diluted stream before the diluted stream is drawn into the engine 236 via the engine air inlet 232. The diluted stream conveys the captured GHG emissions into the air-fuel system of the engine 236 through the engine air inlet 232 in a manner that avoids interfering with the engine controls or any sensitive air-fuel ratios or emission control systems.

The control valve 226 facilitates the mixing of air with the emissions captured by the dry gas seal vents 219 and/or the engine crankcase vents 138. The diluted stream exiting the control valve 226 is below the lean flammability limit, so that the diluted stream will not easily combust. In an exemplary embodiment, the composition of the diluted stream is at least twenty percent lean of the stoichiometric ratio of combustion. By managing flow through the GHG capture system 210, the control valve 226 regulates the introduction of the diluted stream to the engine 236 for combustion.

The engine 236 ingests and combusts the diluted stream in order to convert the captured GHG emissions to carbon dioxide. When the engine 236 is in operation, combustion in the engine 236 converts methane and longer chain carbon gases in the diluted stream to carbon dioxide. In this way, the GHG capture system 210 reduces the amount of methane and longer chain carbon gases released to the atmosphere, while increasing the amount of carbon dioxide released to the atmosphere. Longer chain carbon gases generally have greater greenhouse effects than carbon dioxide. Methane, for example, has over twenty times greater greenhouse causing effects as carbon dioxide when released into the atmosphere. The engine 236 combusts the otherwise wasted hydrocarbon gases in the captured emissions to also recover the energy value of the emissions. The diluted GHG emissions are combusted along with a fuel in the engine 236, thereby adding the energy value of the vented emissions to the engine 236. This energy supplements the required energy output from the engine 236, reducing the fuel requirement in proportion to the energy recovered from the captured emissions. This results in a fuel savings during operation of the engine 236.

As noted above, the block and bleed valve 224, when activated, isolates the portion of the GHG capture system 210 upstream of the block and bleed valve 224 from the portion of the GHG capture system 210 downstream of the block and bleed valve 224, thereby protecting the downstream portion including the engine 236. The captured GHG emissions upstream of the block and bleed valve 224 are then diverted out of the GHG capture system 210 via the valve 224 and/or the air filter 222 to the atmosphere and/or a disposal mechanism such as, for example, a flare.

During operation, the flow meters 220 and 230 measure flow rates within, and permit the automation of, the GHG capture system 210 with one or more of the controllers 221 and 227 and other controllers included in the GHG capture system 210, such as a controller 240. For example, using data gleaned from the flow meter 220 and the flow meter 230, the position of the control valve 226 is automatically adjusted with the controller 227 to maintain a correct amount of flow in the correct direction within the GHG capture system 210. As a result of the operation of one or more of the flow meters 220 and 230, the controllers 221, 227 and 240, and other controllers included in the GHG capture system 210, the control function of the system 210 may be decoupled from the pressures within the system 210, the control function of the system 210 does not have to be limited to one or more proportional constants, and/or the control function of the system 210 may be nonlinear.

In several exemplary embodiments, the operation of the GHG capture system 210 presents an approach to GHG recovery through active management of the emissions flow from the dry gas seal vents 219 and the crankcase vents 238, other GHG recovery points, and/or any combination thereof, as needed. Each potential source of captured emissions may be associated with manual or electronic controls to adapt to varying compositions and heating values of the emissions. The GHG capture system 210 does not create back pressure on the dry gas seal vents 219 or the crankcase vents 138, eliminating, or at least reducing, the risk of explosion. In several exemplary embodiments, the GHG capture system 210 does not rely on pressure relief valves to protect machinery and personnel; however, additional instrumentation and safety devices may be applied to the GHG capture system 210 to increase the margin of safety or reliability.

In several exemplary embodiments, the GHG capture system 210 includes other dilution mechanisms that contribute to the mixing of air (and/or another noncombustible fluid) with the captured emissions. These dilution mechanisms may include a simple tube of sufficient length or a specialized chamber with mixing vanes to ensure homogeneous mixing.

In exemplary embodiments, fugitive GHG emissions traditionally released to the atmosphere are captured by shrouds that enclose valves, flanges and/or mechanical connections in proximity to, and/or that are a part of, the GHG capture system 210, as will be described in further detail below in connection with FIGS. 5, 6 and 7.

Figure 4:
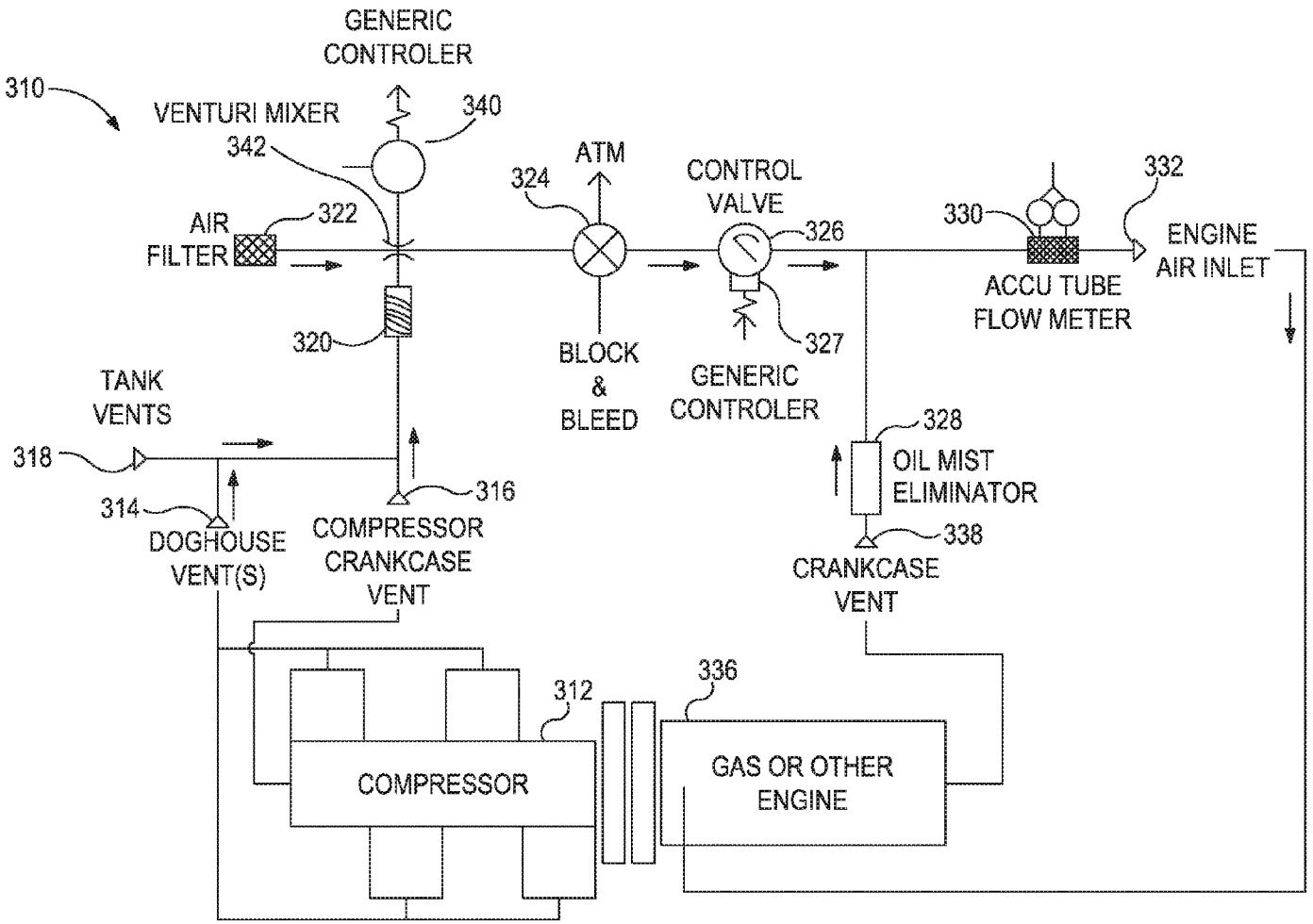
FIG. 4 is a diagrammatic view of a greenhouse gas capture system according to still yet another exemplary embodiment.

In an exemplary embodiment, as illustrated in FIG. 4, a GHG capture system is generally referred to by the reference numeral 310 and includes a compressor 312 with one or more doghouse vents 314 and one or more compressor crankcase vents 316 coupled thereto. The doghouse vents 314, the crankcase vents 316, and one or more tank vents 318 are in fluid communication with a liquid slug separation mechanism 320, which, in turn, is in fluid communication with a valve such as a block and bleed valve 324. An air filter 322 is also in fluid communication with the block and bleed valve 324. A valve such as a control valve 326 is in fluid communication with the block and bleed valve 324. The control valve 326 is electrically coupled to a controller 327. The control valve 326 and an oil mist eliminator 328 are in fluid communication with a flow meter 330, which, in turn, is in fluid communication with an engine air inlet 332, which includes one or more fixed orifices, one or more variable orifices, and/or any combination thereof. The engine air inlet 332 is in fluid communication with an engine 336, which is operably coupled to the compressor 312. One or more engine crankcase vents 338 are coupled to the engine 336 and are in fluid communication with the oil mist eliminator 328. In an exemplary embodiment, the compressor 312 is a four-throw compressor. In several exemplary embodiments, instead of a four-throw compressor, the compressor 312 is another type of compressor. In an exemplary embodiment, the engine 336 is a turbo-compression diesel engine. In several exemplary embodiments, instead of a turbo-compression diesel engine, the engine 336 is another type of engine such as, for example, another type of gasoline engine.

Each of the doghouse vents 314, the compressor crankcase vents 316, the tank vents 318, and the engine crankcase vents 338 includes one or more fixed orifices, one or more variable orifices, and/or any combination thereof, and are configured to capture and direct combustible fluids such as, for example, fugitive or vented emissions including combustible fluids such as, for example, GHG emissions, which are traditionally vented to the atmosphere. More particularly, the doghouse vents 314 and the compressor crankcase vents 316 are configured to capture and direct fugitive or vented GHG emissions from the compressor 312. The tank vents 318 are configured to capture and direct fugitive or vented GHG emissions from one or more tanks in proximity to the GHG capture system 310. The engine crankcase vents 338 are designed to capture and direct fugitive or vented GHG emissions from the engine 336.

In several exemplary embodiments, the doghouse vents 314, the compressor crankcase vents 316, the tank vents 318, and the engine crankcase vents 338 are configured to regulate flows within the GHG capture system 310. The doghouse vents 314, the compressor crankcase vents 316, the tank vents 318, and the engine crankcase vents 338 may include one or more fixed, variable, manual, or automatic flow control devices, and/or any combination thereof, with one or more of the flow control devices including, for example, a back pressure control regulator and/or an electronically controlled valve or regulator, which valves or regulators limit the flow of the emissions though the respective fixed and/or variable orifices of the doghouse vents 314, the compressor crankcase vents 316, the tank vents 318, and the engine crankcase vents 338 to facilitate in controlling pressures within the GHG capture system 310. In an exemplary embodiment, the doghouse vents 314, the compressor crankcase vents 316, the tank vents 318, and the engine crankcase vents 338 also include or otherwise incorporate one or more types of vapor recovery systems for capturing fugitive or vented vapors.

The air filter 322 is configured to filter ambient air (and/or another noncombustible fluid), which is adapted to be drawn into the GHG capture system 310 through the air filter 322 and mix with the fugitive or vented GHG emissions captured and directed by the doghouse vents 314, the compressor crankcase vents 316, the tank vents 318, and the engine crankcase vents 338 to thereby dilute the GHG emissions, under conditions to be described below. In at least one embodiment, a venturi mixer 342 may receive and mix the noncombustible fluid and the fugitive or vented GHG emissions.

The block and bleed valve 324, when activated, is configured to isolate the portion of the GHG capture system 310 upstream of the block and bleed valve 324 from the portion of the GHG capture system 310 downstream of the block and bleed valve 324, thereby protecting the downstream portion including the engine 336. If the block and bleed valve 324 is activated, the captured GHG emissions upstream of the valve 324 are then diverted out of the GHG capture system 310 via the valve 324 and/or the air filter 322 to the atmosphere and/or a disposal mechanism such as, for example, a flare. A controller may be electrically coupled to the block and bleed valve 324 and may be configured to automatically control the block and bleed valve 324.

The control valve 326 is configured to entrain and homogenize the captured GHG emissions and filtered air into a diluted stream. In an exemplary embodiment, the control valve 326 is controlled with the controller 327; the control valve 326 is adjusted by the controller 327 to avoid over-capture of emissions from the doghouse vents 314, the compressor crankcase vents 316, the tank vents 318, and the engine crankcase vents 338, which over-capture may lead to over-saturation of GHG in the diluted stream entering the engine air inlet 332 and thus possible damage to the engine 336. In an exemplary embodiment, the controller 327 is configured to respond to changes in the composition of the captured emissions by adjusting the control valve 326 to optimize GHG capture in order to keep the diluted stream below the lean flammability limit, thereby protecting existing engine control and emission systems. The control valve 326 may be electrically controlled for immediate and accurate control of pressures within the GHG capture system 310.

The liquid slug separation mechanism 320 is configured to treat the captured GHG emissions from the doghouse vents 314, the crankcase vents 316, and the tank vents 318. The captured emissions may include condensable vapors that might damage the engine 336 by erratic combustion or destructive detonation. The liquid slug separation mechanism 320 protects the engine 336 even when emissions that are unsuitable for being mixed with air and fed to the engine 336 are captured from the doghouse vents 314, the crankcase vents 316, the tank vents 318, and/or any combination thereof. In an exemplary embodiment, the liquid slug separation mechanism 320 includes a tubular member and a cooling coil associated therewith, the cooling coil defining an internal passage that is fluidically coupled to a coolant inflow line at one end and a coolant return line at the other end. The liquid slug separation mechanism 320 may further include a level control and dump. Coolant is configured to enter into the internal passage defined by the coil of the liquid slug separation mechanism 320 via the coolant inflow line, flow through the internal passage defined by the coil of the liquid slug separation mechanism, and exit the internal passage via the coolant return line; in an exemplary embodiment, the coolant is engine coolant associated with, for example, the engine 336.

The flow meter 330 is configured to measure the flow rate of the diluted stream into the engine air inlet 322. A controller may be electrically coupled to the flow meter 330, and may be configured to automatically control one or more of the flow meter 330, one or more of the orifices of one or more of the doghouse vents 314, the compressor crankcase vents 316, the tank vents 318, and the engine crankcase vents 338, the block and bleed valve 324, one or more of the remaining components of the GHG capture system 310, and/or any combination thereof.

In operation, in an exemplary embodiment, the engine 336 operates to drive the compressor 312, during which the engine 336 ingests air via the engine air inlet 336 and/or one or more inlets other than the engine air inlet 332. As a result of the operation of the engine 336, GHG emissions are generated, and at least a portion of these emissions are captured and directed by the engine crankcase vents 338. As a result of the operation of the compressor 312, GHG emissions are generated, and at least a portion of these emissions are captured and directed by the doghouse vents 314 and the compressor crankcase vents 316. GHG emissions are also captured and directed by the tank vents 318. During the normal operation of the engine 336 and the compressor 312, the block and bleed valve 324 and the control valve 326 are open or at least partially open, allowing fluid to flow therethrough, and the inlet pressure of the air filter 322 is at atmospheric pressure, the pressure between the engine 336 and the engine crankcase vents 338 is at or near atmospheric pressure, the pressure downstream of the doghouse vents 314, the compressor crankcase vents 316 and the tank vents 318 is less than atmospheric pressure, the pressure downstream of the block and bleed valve 324 (and thus upstream of the control valve 326) is less than atmospheric pressure, and the pressure at the engine air inlet 332 is less than the pressure upstream of the control valve 326.

As a result of the foregoing pressure differentials, air (and/or another noncombustible fluid) is drawn into the GHG capture system 310 via the air filter 322 and flows toward the block and bleed valve 324. Further, GHG emissions captured and directed by the tank vents 318, the doghouse vents 314 and the compressor crankcase vents 316 also flow toward the block and bleed valve 324; as a result, these GHG emissions mix with, and thus are diluted by, the air flowing through the air filter 322. The diluted stream flows through the block and bleed valve 324 and the control valve 326. Since the inlet pressure of the control valve 326 is above the inlet pressure of the engine air inlet 332, the diluted stream is drawn into the engine 336 via the engine air inlet 332. Since the pressure between the engine 336 and the engine crankcase vents 338 is at or near atmospheric pressure, GHG emissions captured and directed by the engine crankcase vents 338 flow toward the engine air inlet 332, thereby mixing with, and thus being diluted by, the diluted stream before the diluted stream is drawn into the engine 336 via the engine air inlet 332. The diluted stream conveys the captured GHG emissions into the air-fuel system of the engine 336 through the engine air inlet 332 in a manner that avoids interfering with the engine controls or any sensitive air-fuel ratios or emission control systems.

The control valve 326 facilitates the mixing of air with the emissions captured by the doghouse vents 314, the compressor crankcase vents 316, and the tank vents 318, and/or the engine crankcase vents 338. The diluted stream exiting the control valve 326 is below the lean flammability limit, so that the diluted stream will not easily combust. In an exemplary embodiment, the composition of the diluted stream is at least twenty percent lean of the stoichiometric ratio of combustion. By managing flow through the GHG capture system 310, the control valve 326 regulates the introduction of the diluted stream to the engine 336 for combustion.

The engine 336 ingests and combusts the diluted stream in order to convert the captured GHG emissions to carbon dioxide. When the engine 336 is in operation, combustion in the engine 336 converts methane and longer chain carbon gases in the diluted stream to carbon dioxide. In this way, the GHG capture system 310 reduces the amount of methane and longer chain carbon gases released to the atmosphere, while increasing the amount of carbon dioxide released to the atmosphere. Longer chain carbon gases generally have greater greenhouse effects than carbon dioxide. Methane, for example, has over twenty times greater greenhouse causing effects as carbon dioxide when released into the atmosphere. The engine 336 combusts the otherwise wasted hydrocarbon gases in the captured emissions to also recover the energy value of the emissions. The diluted GHG emissions are combusted along with a fuel in the engine 336, thereby adding the energy value of the vented emissions to the engine 336. This energy supplements the required energy output from the engine 336, reducing the fuel requirement in proportion to the energy recovered from the captured emissions. This results in a fuel savings during operation of the engine 336.

As noted above, the block and bleed valve 324, when activated, isolates the portion of the GHG capture system 310 upstream of the block and bleed valve 324 from the portion of the GHG capture system 310 downstream of the block and bleed valve 324, thereby protecting the downstream portion including the engine 336. The captured GHG emissions upstream of the block and bleed valve 324 are then diverted out of the GHG capture system 310 via the valve 324 and/or the air filter 322 to the atmosphere and/or a disposal mechanism such as, for example, a flare.

During operation, the liquid slug separation mechanism 320 removes unsuitable condensable vapors from the GHG emissions flowing from the doghouse vents 314, the crankcase vents 316 and the tank vents 318, before the GHG emissions are mixed with the filtered air flowing from the air filter 322. The liquid slug separation mechanism 320 treats the captured GHG emissions from the doghouse vents 314, the crankcase vents 316, and the tank vents 318. The liquid slug separation mechanism 320 protects the engine 336 even when emissions that are unsuitable for being mixed with air and fed to the engine 336 are captured from the doghouse vents 314, the crankcase vents 316, the tank vents 318, and/or any combination thereof.

The flow meter 330 measures flow rates within, and permits the automation of, the GHG capture system 310 with the controller 327 and other controllers included in the GHG capture system 310, such as a controller 340. For example, using data gleaned from the flow meter 330, the position of the control valve 326 is automatically adjusted with the controller 327 to maintain a correct amount of flow in the correct direction within the GHG capture system 310.

In several exemplary embodiments, the operation of the GHG capture system 310 presents an approach to GHG recovery through active management of the emissions flow from the doghouse vents 314, the crankcase vents 316, the tank vents 318, and the crankcase vents 338, other GHG recovery points, and/or any combination thereof, as needed. Each potential source of captured emissions may be associated with manual or electronic controls to adapt to varying compositions and heating values of the emissions. The GHG capture system 310 does not create back pressure on the doghouse vents 314, the crankcase vents 316, the tank vents 318, or the crankcase vents 338, eliminating, or at least reducing, the risk of explosion. In several exemplary embodiments, the GHG capture system 310 does not rely on pressure relief valves to protect machinery and personnel; however, additional instrumentation and safety devices may be applied to the GHG capture system 310 to increase the margin of safety or reliability.

In several exemplary embodiments, the GHG capture system 310 includes other dilution mechanisms that contribute to the mixing of air (and/or another noncombustible fluid) with the captured emissions. These dilution mechanisms may include a simple tube of sufficient length or a specialized chamber with mixing vanes to ensure homogeneous mixing.

In exemplary embodiments, fugitive GHG emissions traditionally released to the atmosphere are captured by shrouds that enclose valves, flanges and/or mechanical connections in proximity to, and/or that are a part of, the GHG capture system 310, as will be described in further detail below in connection with FIGS. 5, 6 and 7.

Figure 5:
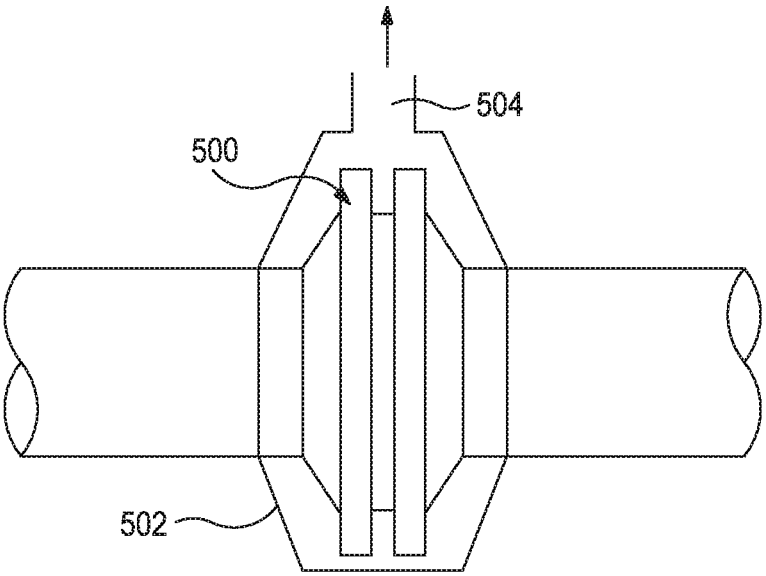
FIG. 5 is a partial elevational/partial sectional view of a flanged connection in fluid communication with one or more components of the greenhouse gas capture system of FIG. 1, 2, 3 or 4, according to an exemplary embodiment.

In an exemplary embodiment, as illustrated in FIG. 5 with reference to FIGS. 1, 2, 3 and 4, a flanged connection 500 between two pipes is enclosed by a shroud 502. A gasket may be located between the flanges of the two pipes. In an exemplary embodiment, the internal region defined by the shroud 502 is in fluid communication with one of the components of the capture systems described above and illustrated in FIG. 1, 2, 3 or 4. For example, the internal region defined by the shroud 502 may be in fluid communication with the block and bleed valve 24 of the GHG capture system 10 in a manner similar to the above-described manner by which the tank vents 18 are in fluid communication with the block and bleed valve 24. During exemplary operation, fugitive emissions leak from the flanged connection 500 and are captured in the internal region defined by the shroud 502. The pressure in the internal region defined by the shroud 502 is greater than the pressure at the outlet of the control valve 26; as a result, the fugitive emissions flow from the internal region defined by the shroud 502, through an opening 504, and to the control valve 26 and thus are mixed with the air flowing from the air filter 22 to the control valve 26, thereby diluting the fugitive emissions in a manner similar to the manner by which the GHG emissions are diluted during the above-described operation of the GHG capture system 10. In an exemplary embodiment, one or more controlled air leaks may be provided at the interface between the shroud 502 and the two pipes between which the flanged connection 500 is formed, avoiding the complexity of providing an air-tight seal for the shroud 502. Alternatively, the air leaks may be sealed so that the shroud 502 is evacuated by, for example, the GHG capture system 10.

Figure 6:
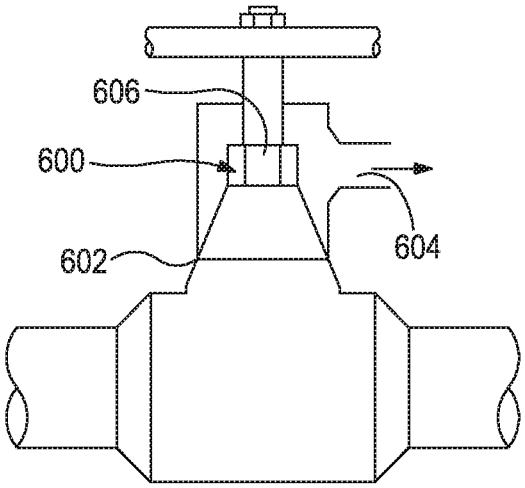
FIG. 6 is a partial elevational/partial sectional view of a valve body in fluid communication with one or more components of the greenhouse gas capture system of FIG. 1, 2, 3 or 4, according to an exemplary embodiment.

In an exemplary embodiment, as illustrated in FIG. 6 with reference to FIGS. 1, 2, 3 and 4, a valve stem connection 600 along a pipe is enclosed by a shroud 602. In an exemplary embodiment, the internal region defined by the shroud 602 is in fluid communication with one of the components of the capture systems described above and illustrated in FIG. 1, 2, 3 or 4. For example, the internal region defined by the shroud 602 may be in fluid communication with the block and bleed valve 24 of the GHG capture system 10 in a manner similar to the above-described manner by which the tank vents 18 are in fluid communication with the block and bleed valve 24. During exemplary operation, fugitive emissions leak from the valve stem connection 600 and are captured in the internal region defined by the shroud 602. In an exemplary embodiment, the leaking of fugitive emissions from the valve stem connection 600 may be characterized as stem packing leaks. The pressure in the internal region defined by the shroud 602 is greater than the pressure at the outlet of the control valve 26; as a result, the fugitive emissions flow from the internal region defined by the shroud 602, through an opening 604, and to the control valve 26 and thus are mixed with the air flowing from the air filter 22 to the control valve 26, thereby diluting the fugitive emissions in a manner similar to the manner by which the GHG emissions are diluted during the above-described operation of the GHG capture system 10. In an exemplary embodiment, one or more controlled air leaks may be provided at the interface between the shroud 602 and the valve stem connection 600, avoiding the complexity of providing an air-tight seal for the shroud 602. Alternatively, the air leaks may be sealed so that the shroud 602 is evacuated by, for example, the GHG capture system 10.

Figure 7:
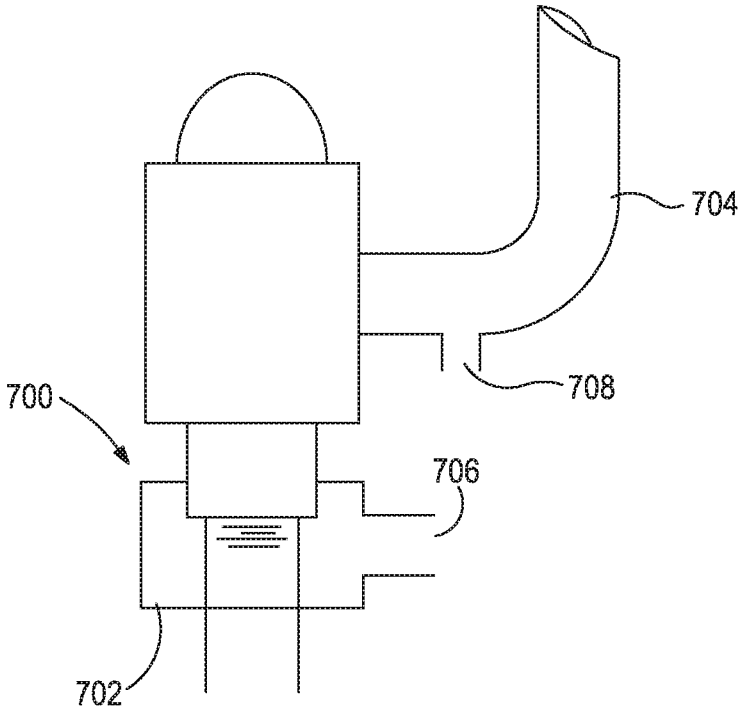
FIG. 7 is a partial elevational/partial sectional view of a pressure relief valve in fluid communication with one or more components of the greenhouse gas capture system of FIG. 1, 2, 3 or 4, according to an exemplary embodiment.

In an exemplary embodiment, as illustrated in FIG. 7 with reference to FIGS. 1, 2, 3 and 4, a connection 700 between a pressure relief valve and the end of a pipe is enclosed by a shroud 702. The pressure relief valve is, for example, threadably engaged with the end of the pipe, and is open to the atmosphere via a tube 704. In an exemplary embodiment, the internal region defined by the shroud 702 is in fluid communication with one of the components of the capture systems described above and illustrated in FIG. 1, 2, 3 or 4. For example, the internal region defined by the shroud 702 may be in fluid communication with the block and bleed valve 24 of the GHG capture system 10 in a manner similar to the above-described manner by which the tank vents 18 are in fluid communication with the block and bleed valve 24. During exemplary operation, fugitive emissions leak from the connection 700 and are captured in the internal region defined by the shroud 702. The pressure in the internal region defined by the shroud 702 is greater than the pressure at the outlet of the control valve 26; as a result, the fugitive emissions flow from the internal region defined by the shroud 702, through an opening 706, and to the control valve 26 and thus are mixed with the air flowing from the air filter 22 to the control valve 26, thereby diluting the fugitive emissions in a manner similar to the manner by which the GHG emissions are diluted during the above-described operation of the GHG capture system 10. In an exemplary embodiment, one or more controlled air leaks may be provided at the interface between the shroud 702 and the pressure relief valve and/or the pipe of the connection 700, avoiding the complexity of providing an air-tight seal for the shroud 702. Alternatively, the air leaks may be sealed so that the shroud 702 is evacuated by, for example, the GHG capture system 10. During exemplary operation, fugitive emissions from sealing leaks in the pressure relief valve may be captured in the tube 704, which may be in fluid communication with, for example, the block and bleed valve 24 of the GHG capture system 10 in a manner similar to the above-described manner by which the tank vents 18 are in fluid communication with the block and bleed valve 24. The pressure in the tube 704 may be less than atmospheric pressure, but may be greater than the pressure at the outlet of the control valve 26; as a result, the fugitive emissions from sealing leaks in the pressure relief valve may flow from the tube 706, through an opening 708, and to the control valve 26 and thus may be mixed with the air flowing from the air filter 22 to the control valve 26, thereby diluting the fugitive emissions in a manner similar to the manner by which the GHG emissions are diluted during the above-described operation of the GHG capture system 10.

Figure 8:
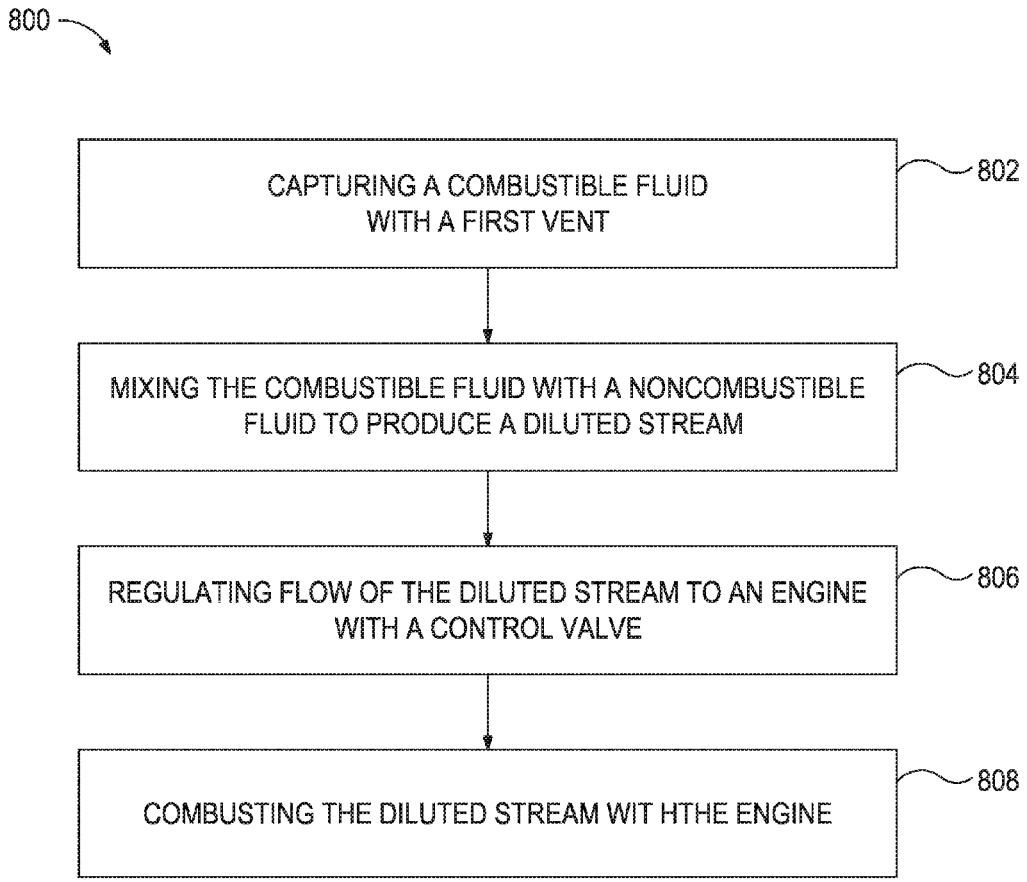
FIG. 8 is a flow chart illustration of a method for capturing emissions, according to an exemplary embodiment.

FIG. 8 is a flow chart illustration of a method 800 for capturing emissions, according to an exemplary embodiment. The method 800 includes capturing a combustible fluid with a first vent, as shown at 802. The method 800 also includes mixing the combustible fluid with a noncombustible fluid to produce a diluted stream, as shown at 804. The method 800 further includes regulating flow of the diluted stream to an engine with a control valve, as shown at 806. The method 800 further includes combusting the diluted stream with the engine, as shown at 808.

Although the present disclosure has described embodiments relating to specific environments, it is understood that the apparatus, systems and methods described herein could be applied to other environments. For example, different types of rotating machinery may be configured for use with embodiments of the GHG capture systems described above.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A system for capturing emissions, comprising:

a first vent configured to capture a first combustible fluid;

an inlet configured to filter a noncombustible fluid, wherein the first combustible fluid and the noncombustible fluid are combined to form a diluted stream;

a first valve in fluid communication with the first vent and the inlet and configured to receive and control flow of the diluted stream;

an engine in fluid communication with the first valve and configured to receive and combust the diluted stream;

a second vent coupled to the engine and configured to capture a second combustible fluid from the engine;

a compressor coupled to the engine and configured to be driven by the engine, wherein the first vent is coupled to the compressor and configured to capture the first combustible fluid from the compressor;

a liquid separation mechanism coupled to the first vent upstream of the diluted stream and configured to remove condensable vapors from the first combustible fluid; and a second valve in fluid communication with the first vent, the inlet, and the first valve, wherein the second valve is configured to direct the diluted stream to at least one of surrounding atmosphere and a disposal mechanism when the second valve is activated.

2. The system of claim 1, further comprising:

a flow meter coupled to the first vent and configured to measure a flow rate of the first combustible fluid from the first vent;

a valve stem connection enclosed by a first shroud, the first shroud in fluid communication with the first valve; and a flanged connection enclosed by a second shroud, the second shroud in fluid communication with the first valve and configured to capture a third combustible fluid.

3. The system of claim 2, wherein the first shroud defines an internal region having a pressure greater than a pressure at an outlet of the first valve.

4. The system of claim 2, wherein the first shroud is configured to provide a controlled air leak at an interface between the first shroud and the valve stem connection.

5. The system of claim 2, wherein, the second shroud is configured to provide a controlled air leak at an interface between the second shroud and the flanged connection.

6. The system of claim 1, wherein the inlet is an air filter and the noncombustible fluid is air.

7. The system of claim 1, wherein the engine converts the first combustible fluid within the diluted stream to carbon dioxide.

8. The system of claim 1, wherein the engine is a turbo-compression diesel engine.

9. The system of claim 1, wherein the first combustible fluid comprises greenhouse gas emissions from the compressor.

10. The system of claim 1, wherein the liquid separation mechanism further comprises a tubular member and a cooling coil configured to remove the condensable vapors from the first combustible fluid.

11. A system for capturing emissions, comprising:

an engine coupled to and configured to drive a compressor;

a first vent coupled to the compressor and configured to capture a first stream of greenhouse gas emissions from the compressor;

a liquid separation mechanism coupled to the first vent and configured to remove condensable vapors from the first stream of greenhouse gas emissions;

an inlet configured to filter a stream of air, wherein the first stream of greenhouse gas emissions and the stream of air are combined to form a first diluted stream;

a first valve in fluid communication with the first vent and the inlet, the first valve configured to receive and control flow of the first diluted stream;

a second vent coupled to the engine and configured to capture a second stream of greenhouse gas emissions from the engine, wherein the first diluted stream and the second stream of greenhouse gas emissions are combined to form a second diluted stream;

an engine inlet configured to receive the second diluted stream and to provide the second diluted stream to the engine, wherein the engine combusts the second diluted stream; and a second valve coupled to the first vent and the inlet, the second valve configured to prevent flow therethrough when activated.

12. The system of claim 11, further comprising:

a first flow meter coupled to the first vent and configured to measure a flow rate of the first stream of greenhouse gas emissions from the first vent;

a valve stem connection enclosed by a first shroud, the first shroud in fluid communication with the first valve; and a flanged connection enclosed by a second shroud, the second shroud in fluid communication with the first valve and configured to capture a third stream of greenhouse gas emissions, wherein the liquid separation mechanism is coupled to the first vent and disposed upstream of the first diluted stream and the second diluted stream.

13. The system of claim 12, further comprising a second flow meter coupled to the engine inlet and configured to measure a flow rate of the second diluted stream.

14. The system of claim 13, further comprising a controller coupled to the first valve and at least one of the first and second flow meters, wherein the controller is configured to adjust a position of the first valve in response to data from at least one of the first and second flow meters.

15. The system of claim 12, wherein the first shroud defines an internal region having a pressure greater than a pressure at an outlet of the first valve.

16. The system of claim 12, wherein the first shroud is configured to provide a controlled air leak at an interface between the first shroud and the valve stem connection.

17. The system of claim 11, further comprising a third vent coupled to the compressor and configured to capture a third stream of greenhouse gas emissions from the compressor, wherein the first vent is a doghouse vent and the third vent is a compressor crankcase vent.

18. The system of claim 11, wherein the liquid separation mechanism further comprises a tubular member and a cooling coil configured to remove the condensable vapors from the first stream of greenhouse gas emissions.

* * * * *